US006348235B1

(12) United States Patent
Cavill et al.

(10) Patent No.: US 6,348,235 B1
(45) Date of Patent: Feb. 19, 2002

(54) PAINTING APPARATUS AND METHOD

(75) Inventors: David P. Cavill, Ozona; Steven R Canfield, Tarpon Springs, both of FL (US)

(73) Assignee: Driveway Magic, Tarpon Springs, FL (US)

( * ) Notice: Subject to any disclaimer, the term of this patent is extended or adjusted under 35 U.S.C. 154(b) by 0 days.

(21) Appl. No.: 09/543,714

(22) Filed: Apr. 5, 2000

Related U.S. Application Data

(60) Provisional application No. 60/128,315, filed on Apr. 8, 1999.

(51) Int. Cl.[7] ..... B05D 1/28; B05D 5/06

(52) U.S. Cl. ..... 427/280; 427/428; 15/230.11; 15/257.01; 15/257.06; 220/570

(58) Field of Search ..... 427/428, 261, 427/262, 267, 280; 15/230.11, 257.06, 257.01; 220/570, 271

(56) References Cited

U.S. PATENT DOCUMENTS 3,536,037 A * 10/1970 Mortellito ..... 118/102
3,669,069 A 6/1972 Bourboulis
4,930,179 A * 6/1990 Wright et al. ..... 15/230.11
5,117,529 A * 6/1992 Ohta ..... 15/230.11
5,178,274 A * 1/1993 Long ..... 206/361
5,577,291 A 11/1996 Myers et al.
5,626,672 A 5/1997 Rossetti
5,693,141 A * 12/1997 Tramont ..... 118/211
5,711,047 A 1/1998 Armaly, Jr.
5,806,130 A 9/1998 Pascoe
5,966,772 A * 10/1999 Woodnorth et al. ..... 15/230.11
5,984,129 A * 11/1999 Pasinski ..... 220/570
6,012,198 A * 1/2000 Thole ..... 15/257.06

FOREIGN PATENT DOCUMENTS

GB 553552 5/1943

* cited by examiner

*Primary Examiner*—Shrive P. Beck
*Assistant Examiner*—Kirsten A. Crockford
(74) *Attorney, Agent, or Firm*—David Kiewit

(57) ABSTRACT

A design roller sleeve has a plurality of absorbent strips that wrap about the axis of a paint roller in a helical fashion. Each of the strips has an array of flaps, in which large and small flaps are preferably alternated, extending outward from a backing portion of the strip. This roller is intended to be used for applying a visually random pattern to a uniformly colored and relatively wide horizontal surface such as a concrete driveway or patio When used for this purpose the design roller sleeve is loaded with paint and then spun within a spatter-box to remove excess paint before rolling a partly colored swath on the surface. In some cases the spatter-box is made on a job site by tearing away part of a lid of a shipping carton previously used to transport a design roller painting kit.

3 Claims, 3 Drawing Sheets

PAINTING APPARATUS AND METHOD

CROSS REFERENCE TO RELATED APPLICATIONS

This application claims the priority of U.S. provisional application for patent 60/128,315 filed Apr. 8, 1999

STATEMENT REGARDING FEDERALLY SPONSORED RESEARCH OR DEVELOPMENT

Not Applicable

BACKGROUND OF THE INVENTION

Field of the Invention

The invention relates to apparatus a method for painting a visually random pattern on a generally horizontal surface, such as a concrete driveway, walkway, garage floor or the like.

Background Information

A variety of techniques have been used to create a textured appearance with paint, principally for the purpose of decorating interior walls. Of particular interest are those involving the use of two contrasting paint colors in which a base coat is applied and allowed to dry, following which a pattern is formed by painting over the base coat with a differently colored paint or other colorant that covers only portions of the surface. In some cases the second coat is applied only to portions of the surface. In others, the second coat is applied evenly and is then removed from portions of the surface.

BRIEF SUMMARY OF THE INVENTION

The invention provides a design roller sleeve comprising a plurality of absorbent strips having an array of flaps extending laterally outward from each strip. The strips are preferably helically disposed about the axis of a paint roller. In a preferred embodiment, large flaps and small flaps are alternated along the length of a strip.

The invention provides a method of applying a visually random pattern to a relatively wide horizontal surface (e.g., a concrete driveway or patio). A preferred method comprises the steps of:1) Painting the surface with a conventional paint roller so as to cover the surface with a uniform base coat that is allowed to dry. 2) Loading a design roller sleeve with paint having a color different from that of the base coat. 3) Inserting the paint-laden design roller into a spatter-box and spinning it so as to remove excess paint from the roller. This box preferably comprises both a partially covered top and a bottom portion that is impermeable to the paint or other colorant material. 4) Applying the paint remaining in the paint-laden design roller sleeve to the surface by using a plurality of juxtaposed straight strokes having a preferred direction (e.g., pulling or pushing the roller from the outside edge of the driveway towards the middle).

One of the features of the invention is that it may provide a driveway design painting kit for sale to a homeowner. The kit comprises at least one or more design roller sleeves and a roller having one or more elongated handles packed in a box having a colorant-impermeable lower portion and having a top that is perforated or otherwise marked so that part of the top can be removed while the remainder of the top remains on the box to form a spatter-box for removing excess paint from the roller. The kit may also comprise a conventional paint roller tray, stencils for forming decorative patterns, paints, rags, etc.

Although it is believed that the foregoing recital of features and advantages may be of use to one who is skilled in the art and who wishes to learn how to practice the invention, it will be recognized that the foregoing recital is not intended to list all of the features and advantages, Moreover, it may be noted that various embodiments of the invention may provide various combinations of the hereinbefore recited features and advantages of the invention, and that less than all of the recited features and advantages may be provided by some embodiments.

DETAILED DESCRIPTION OF THE INVENTION

Figure 1:
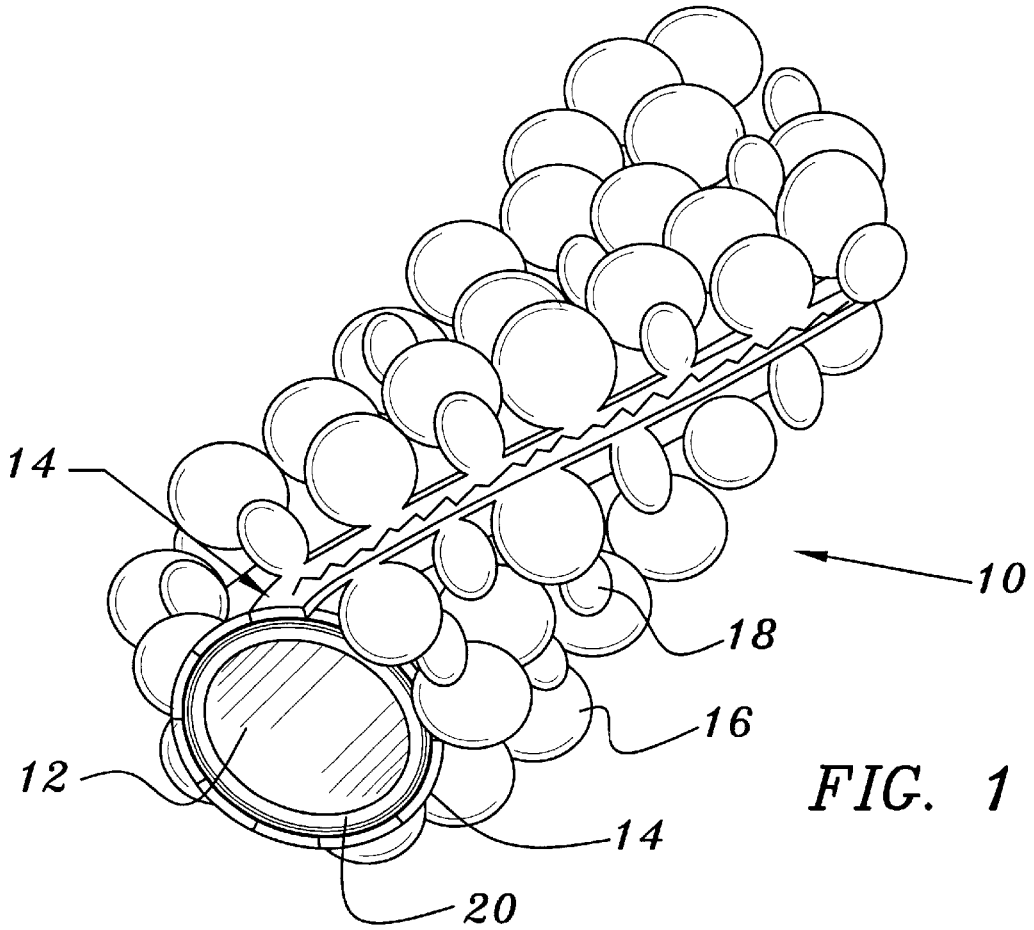
FIG. 1 is an elevational view of a design roller of the invention.
Figure 2:
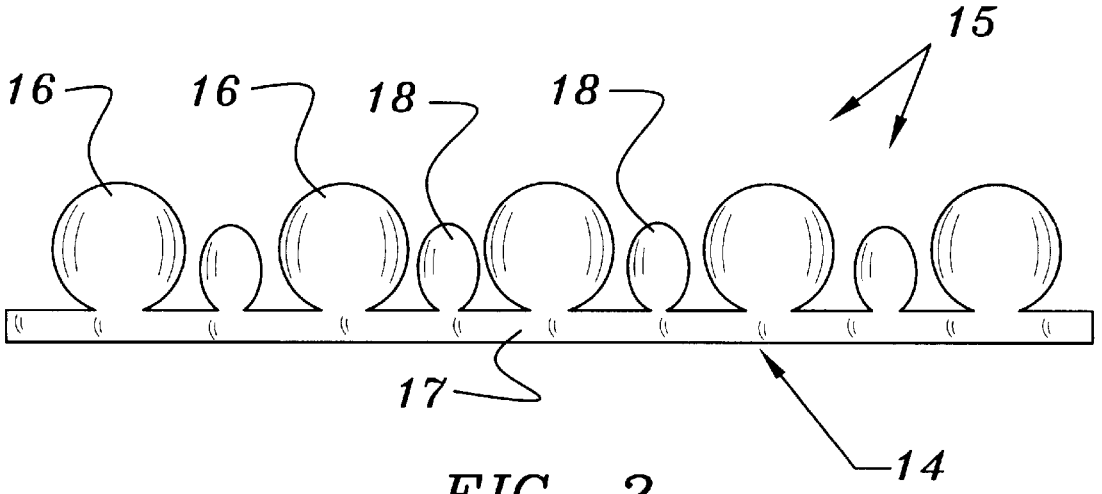
FIG. 2 is a detailed elevational view of an absorbent strip used in the design roller of FIG. 1.

Turning now to FIG. 1, one finds a design roller sleeve 10 comprising a conventional phenolic roller core 12 of the sort adapted to have a painting roller cage 13 removably inserted thereinto. The design roller sleeve 10 preferably has a plurality of flap-strips 14 on its outer surface. Each of the flap-strips 14 comprises an array of flaps 15 extending outwardly from a backing strip 17. Although the flaps 15 may be separate pieces, it is preferred that they be cut from the same piece of material used for the backing strip 17. In a preferred embodiment there is an array of large flaps 16 alternating in a juxtaposed relationship with small flaps 18. In preferred embodiment the large flaps 16 extend outward from the backing strip 17 more or less twice as far as do the small flaps 18. Tests on various design rollers 10 have established that having two disparate flap sizes aids in generating a visually random pattern.

The flap strips 14 are preferably attached to an elastic sock 20 attached to the roller core 12 by some suitable means, such as gluing or sewing. In a preferred embodiment, between five and ten of the flap strips 14 (with the currently preferred embodiment using eight) are wrapped about the roller core 12 in a helical fashion so that the strips make an angle of between ninety and one hundred seventy five degrees of arc with the base of the roller core 14 (i.e., between zero and eighty five degrees with the axis of the roller). Optimal results have been obtained when the angle between the base of the roller core and the flap strip is about one hundred twenty five degrees.

Although a wide variety of absorbent materials may be considered for use in making the flap-strips, a preferred flap strip is made from a synthetic chamois manufactured by the DuPont Corporation and consisting of 85% Lyocell fabric laminated to itself by a 15% polyethylene binder.

Figure 3:
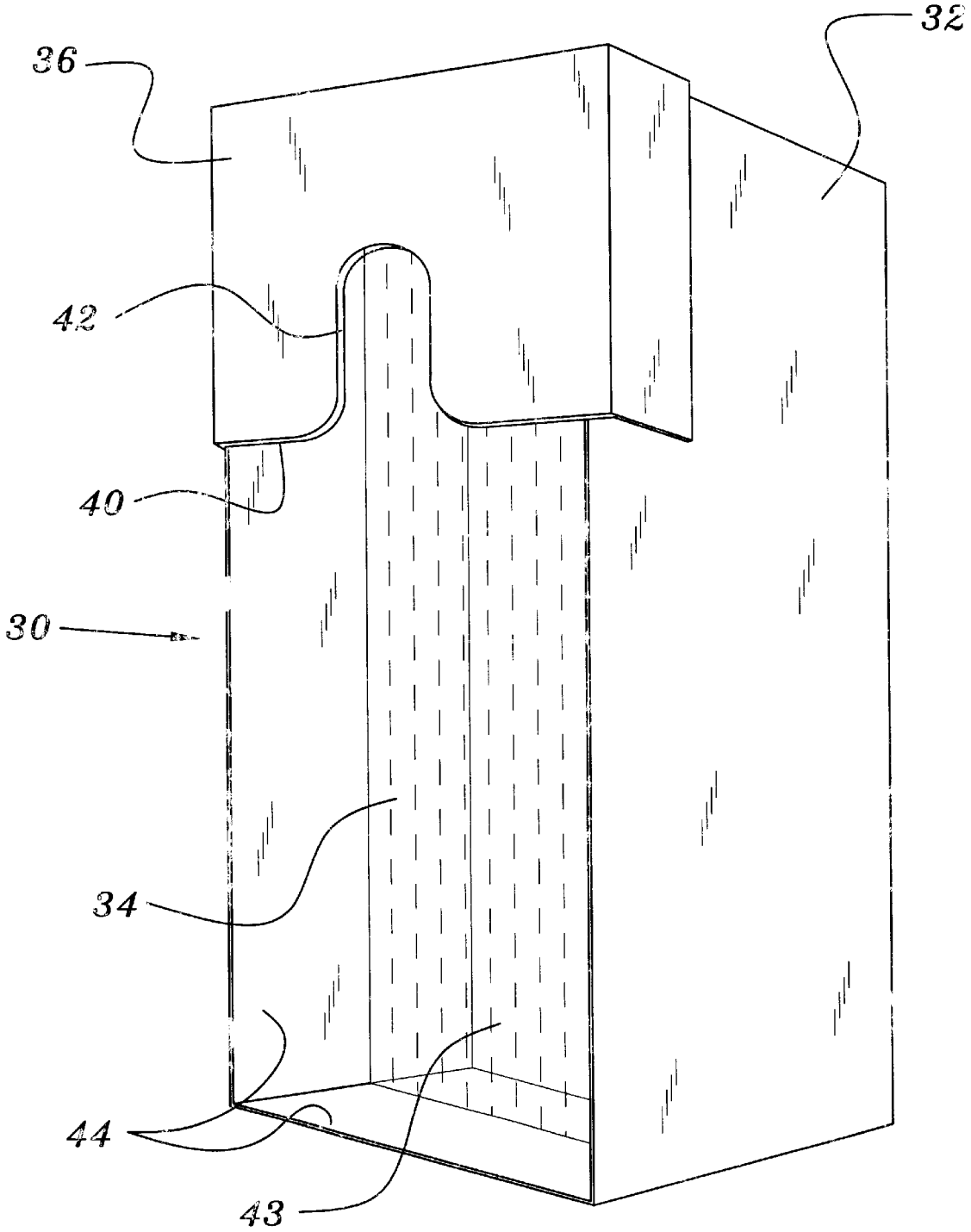
FIG. 3 is an elevational view of a portion of a shipping box used for removing excess paint from a roller.
Figure 4:
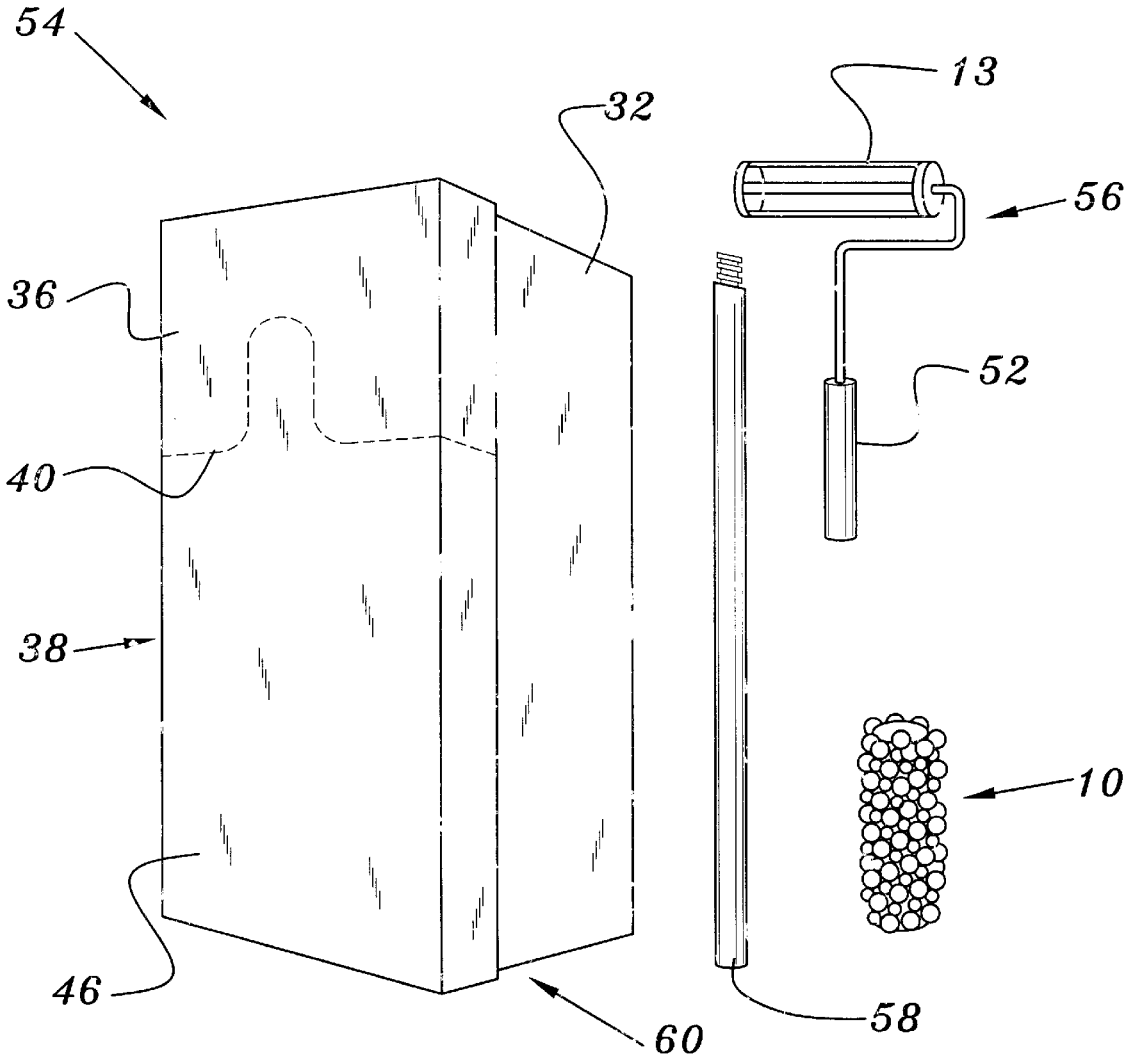
FIG. 4 is an elevational view of elements of a paint rolling kit

Turning now to FIG. 3, one finds a spatter-box 30 that preferably comprises a corrugated paperboard box 32 having a lower portion 34 coated with a colorant-impermeable material. It will be understood by those skilled in the art that the box 32 may be made from a wide variety of commercially available materials and that the selection of corrugated paperboard for the preferred box is a matter only of cost. The paint-impermeable material may be a wax film, a plastic film bonded to the box, or any other arrangement for ensuring that paint spills and spatters do not soak through the box 32 and soil whatever surface the box is placed upon when in use. A spatter-top 36 is placed on the box 32 so as to close off one end thereof. In a preferred embodiment, the spatter-top 36 is formed from a complete top 38 of the box 32 by tearing or cutting along a perforated or otherwise marked line 40 so as to separate a second portion 46 of the complete top 38 from the spatter-top 36. In a preferred embodiment, the perforation comprises a curved portion so that separating two parts of the top 38 forms a spatter-top 36 having a bifurcating indentation 42. Thus, when prepared for use, a preferred spatter-box 30 comprises a box 32 having a paint-impermeable bottom portion and a plurality of upstanding side walls 44, and a spatter-top 36 extending over only a portion of the box 32.

In a preferred embodiment of the invention, a textured surface or an insertable piece of textured material 48 is placed on the bottom 43 of the spatter-box 30 to aid the painter in spinning the roller sleeve 10. This feature may be provided by supplying an appropriately shaped piece of one-side corrugated cardboard having fluting of the size conventionally referred to as "B-flute".

The apparatus of the invention can be used for applying a design to many different surfaces. Of particular interest is improving the appearance of a concrete driveway, a patio, a pool deck or a garage floor with a multi-colored stain or paint coating covering only portions of a painted area. This method provides an aesthetically more pleasing appearance, and also hides surface cracks in the concrete. A preferred approach for doing this involves initial steps of cleaning the concrete surface and coating it uniformly with a base color, which is normally selected to be the lighter of two colors used in the overall process. The base color may be applied by spraying, roller-coating, or by any other conventional means of applying concrete paint or stain. Normally, two coats of concrete paint of the selected base color are applied and allowed to dry in order to ensure uniform coloration prior to adding the decorative design colorant.

In some cases other decorative features, such as an accent strip that looks like a row of bricks, may be added to the uniformly surface before applying the visually random pattern with a design roller 10. For example, it is known to apply an imitation brick pattern to selected portions a concrete surface by placing stencils on the uniformly painted surface and then spraying an appropriate brick-colored aerosol paint through the open portions of the stencil to delineate the brick pattern. It may be noted that the design roller sleeve 10 of the invention can also be used to roll a colorant through open portions of a template. In these cases the user may roll the design sleeve back and forth several times so as to cover most of the areas exposed by the template, while still leaving a few unpainted spots so as to simulate the surface porosity of a brick.

In using the apparatus of the invention to prepare a visually random, partially painted region of a horizontal surface, the painter is directed to load the design roller 10 with paint, stain, or other suitable colorant by using a conventional painting tray 50, to then insert the paint-loaded roller and sleeve into the spatter-box 30 where the roller is rolled briskly along the bottom of the box and lifted therefrom when under the spatter-top 36. This action causes the roller sleeve 10 to spin within the spatter-box 30 and throw off excess paint from the roller sleeve 10. The bifurcating indentation 42 receives the handle 52 of the spinning paint roller during this operation and thus allows the roller to be completely beneath the spatter-top 36 while spinning. This minimizes the amount of paint spattered out of the box, and also fluffs the flaps 15 so that they move more freely and are thus more effective in generating the desired visually random appearance.

The design roller 10 is then preferably placed on the working surface and moved across it in a straight line so as to form an elongated partially colored swath. This design roller 10 may then be reloaded and moved across the surface in a second swath that is parallel to, but preferably spaced very slightly apart from a neighboring swath. This process is repeated until the entire working surface has been painted. It will be understood that inasmuch as the second, design, coat of colorant is only intended to partially cover the surface, some of the painting process steps differ from those used in most painting processes, which seek to provide a uniform surface coverage. These different steps include avoiding an overloaded roller, instructing the painter to not press the design roller 10 down onto the working surface, keeping all of the swaths parallel, not allowing the roller to describe a curve on the surface, and not permitting overlapping strokes.

Although applying too much of the second paint will degrade the design effect, it will be understood to those skilled in the painting arts that applying too little paint will also degrade the design effect by allowing too much of the base color to show. Thus, the painter should also ensure that the design roller 10 does not become too dried out during the course of painting a single swath. The painter is therefore instructed to plan to use swaths of a minimum length compatible with the project In the particular case of painting a driveway, for example, the painter is instructed to paint swaths transverse to the driveway and to work from both sides of the driveway so that a given swath only needs to extend from one edge of the driveway to approximately the middle of the driveway.

In a preferred embodiment, a complete painting kit 54, comprising one or more design rollers 10, a conventional roller frame 56 having a cage 13 configured to rotate about an axle portion of a handle 52, a piece of one-side corrugated cardboard 48, and an extension arm 58 for the roller frame 56 are sold packaged in a shipping container 60 comprising a box 32 and a complete lid 38. The preferred shipping container 60 is convertible to a spatter-box 30 by the simple expedient of removing a portion of the top 38 and covering only one end of the box with the spatter-top 36. It will be understood by those skilled in the art that additional items, such as printed or videotaped instructions, paint trays, rags, conventional rollers for application of a base coat, cans of paint, stencils, etc. may also be included in the kit 54.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is claimed is:

1. A method of applying a colorant to a working surface by use of a paint roller comprising a paint roller frame, the method comprising the sequentially executed steps of:

a) inserting the paint roller frame into a design roller sleeve comprising a plurality of flaps on an outer surface thereof;

b) loading the design roller sleeve with the colorant;

c) spinning the roller within a spatter box while a handle of the roller is received within a bifurcating indentation formed in a top of the spatter box so as to throw excess colorant from the design roller sleeve;

d) placing the roller sleeve on the working surface and forming an elongated, partially colored swath by moving the roller across the surface.

2. The method of claim 1 comprising additional steps after step d) for forming a second swath, spaced apart from the first swath, the additional steps comprising.

e) repeating steps b) and c)

f) placing the roller sleeve on the surface adjacent the swath formed in step d) and moving the roller across the surface so as to form a second swath adjacent the first swath.

3. The method of claim 1 wherein step c) is carried out by moving the roller across a piece of one-side corrugated cardboard adhered to a bottom of the spatter- box.

* * * * *